US010048022B2

(12) United States Patent
Hoffmann et al.

(10) Patent No.: US 10,048,022 B2
(45) Date of Patent: Aug. 14, 2018

(54) HEAT EXCHANGER HAVING PLATE AND HOLDER AND THE PLATE FOR THE HEAT EXCHANGER

(71) Applicant: DENSO International America, Inc., Southfield, MI (US)

(72) Inventors: Jeremy Hoffmann, Apple Valley, MN (US); Parker Farlow, Warren, MI (US)

(73) Assignee: DENSO International America, Inc., Southfield, MI (US)

( * ) Notice: Subject to any disclaimer, the term of this patent is extended or adjusted under 35 U.S.C. 154(b) by 211 days.

(21) Appl. No.: 14/744,125

(22) Filed: Jun. 19, 2015

(65) Prior Publication Data

US 2016/0370117 A1 Dec. 22, 2016

(51) Int. Cl.

| | |
|---|---|
| ***F28D 1/02*** | (2006.01) |
| ***F28D 1/053*** | (2006.01) |
| ***F28F 9/00*** | (2006.01) |
| ***F28F 9/007*** | (2006.01) |
| *F01P 3/18* | (2006.01) |

(52) U.S. Cl.

CPC ..... *F28F 9/002* (2013.01); *F28F 9/007* (2013.01); *F01P 3/18* (2013.01); *F28F 9/001* (2013.01)

(58) Field of Classification Search

CPC ..... F28F 2280/06; F28F 9/001; B60K 11/04
USPC ..... 403/321, 325, 326
See application file for complete search history.

(56) References Cited

U.S. PATENT DOCUMENTS

| | | | | |
|---|---|---|---|---|
| 6,726,397 | B2 * | 4/2004 | Kuehn | A47B 96/06 211/186 |
| 2003/0091385 | A1 * | 5/2003 | Kuehn | A47B 96/06 403/374.1 |
| 2005/0121170 | A1 * | 6/2005 | Maeda | F28D 1/0435 165/67 |
| 2014/0326434 | A1 * | 11/2014 | Farlow | F28F 9/007 165/67 |

FOREIGN PATENT DOCUMENTS

| | | | |
|---|---|---|---|
| EP | 2085735 | A1 | 8/2009 |

* cited by examiner

*Primary Examiner* — Keith Raymond
*Assistant Examiner* — Nael Babaa

(57) ABSTRACT

A plate is equipped to one side of a core of a heat exchanger. A tank is equipped to another side of the core. The tank has a holder in a tubular shape. The holder has a hole in which a plate end is inserted.

5 Claims, 6 Drawing Sheets

HEAT EXCHANGER HAVING PLATE AND HOLDER AND THE PLATE FOR THE HEAT EXCHANGER

TECHNICAL FIELD

The present disclosure relates to a heat exchanger having a plate and holder. The present disclosure further relates to the plate for the heat exchanger.

BACKGROUND

Conventionally, a heat exchanger includes a core having tubes and fins stacked one on top of another. A core may be equipped with tanks to receive thermal medium. A heat exchanger may further include a plate (insert) equipped to a core. It may be desirable to facilitate assembling of those components of the heat exchanger.

SUMMARY

According to an aspect of the disclosure, a heat exchanger comprises a core. The heat exchanger further comprises a plate equipped to one side of the core. The heat exchanger further comprises a tank equipped to an other side of the core. The tank has a holder in a tubular shape. The holder has a hole in which a plate end of the plate is inserted.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

As follows, a first embodiment of the present disclosure will be described with reference to drawings. In the description, a vertical direction is along an arrow represented by "VERTICAL" in drawing(s). A thickness direction is along an arrow represented by "THICKNESS" in drawing(s). A length direction is along an arrow represented by "LENGTH" in drawing(s). A width direction is along an arrow represented by "WIDTH" in drawing(s). A lateral direction is along an arrow represented by "LATERAL" in drawing(s).

Figure 1:
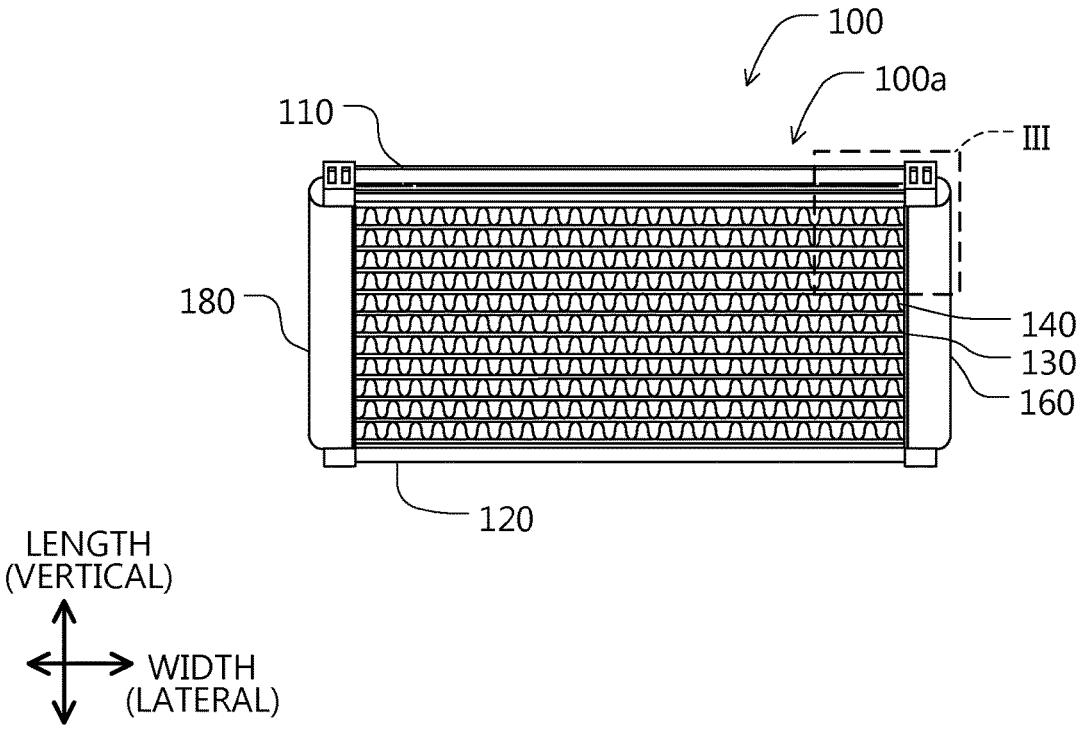
FIG. 1 is a perspective view showing a radiator.

As shown in FIG. 1, a radiator 100 (heat exchanger) includes tanks 160 and 180, multiple tubes 130, multiple fins 140, and plates 110 and 120. The tanks 160 and 180, the tubes 130, the fins 140, and the plates 110 and 120 are integrated with each other and may be brazed into one component. Alternatively, the tanks 160 and 180 may be crimped to a core 100*a* formed of the tubes 130 and the fins 140. The radiator 100 may be connected with an internal combustion engine through unillustrated pipes to circulate cooling water therethrough. The tubes 130 and the fins 140 are stacked alternately in the lateral direction to form the core 100*a*. The alternately stacked tubes 130 and fins 140 are interposed between the tank 160 and 180 at both ends.

Each of the fins 140 is extended in the lateral direction and is interposed between adjacent tubes 130 in the vertical direction. The fin 140 and the adjacent tubes 130 form air passages to flow air therethrough. The fins 140 enhance a performance of heat exchange between the cooling water (thermal medium), which flows through the tubes 130, with air, which passes through the air passages.

One ends of the tubes 130 are inserted into the tank 160 and communicated with a fluid space formed in the tank 160. The other ends of the tubes 130 are inserted into the tank 180 and communicated with a fluid space formed in the tank 180. Thus, the tank 160, the tubes 130, and the tank 180 form a fluid passage to flow the thermal medium therethrough.

One of the plates 110 and 120 is equipped to one side (core side) of the core 100*a* including the fins 140 and the tubes 130. The other of the plates 110 and 120 is equipped to the opposite side (core side) of the core 100*a*. Each of the plates 110 and 120 may be an insert plate, which may be to reinforce the core 100*a*. The tanks 160 and 180 are equipped to the other sides (tank sides) of the core 100*a*.

Figure 2:
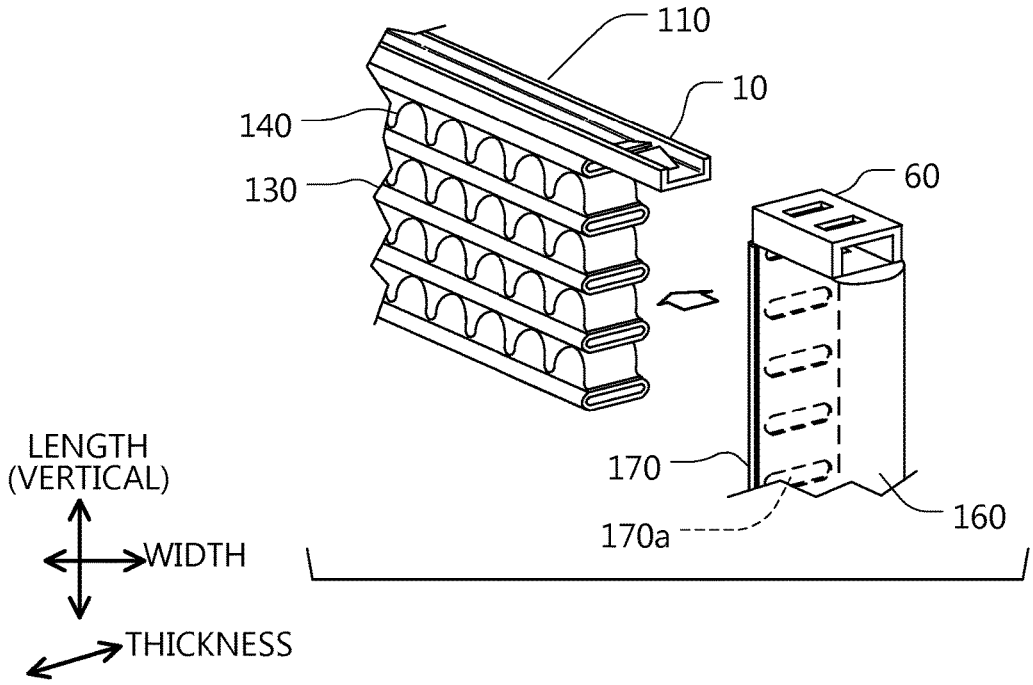
FIG. 2 is a perspective view showing a core, a plate and a tank of the radiator.

As shown in FIG. 2, the tubes 130, the fins 140, and the plate 110 are stacked together. In FIG. 2, illustration of the plate 120 and lower side of the core 100*a* are omitted. The tubes 130, the fins 140, and the plates 110 and 120 may be bound together with a wire (not shown).

Figure 3:
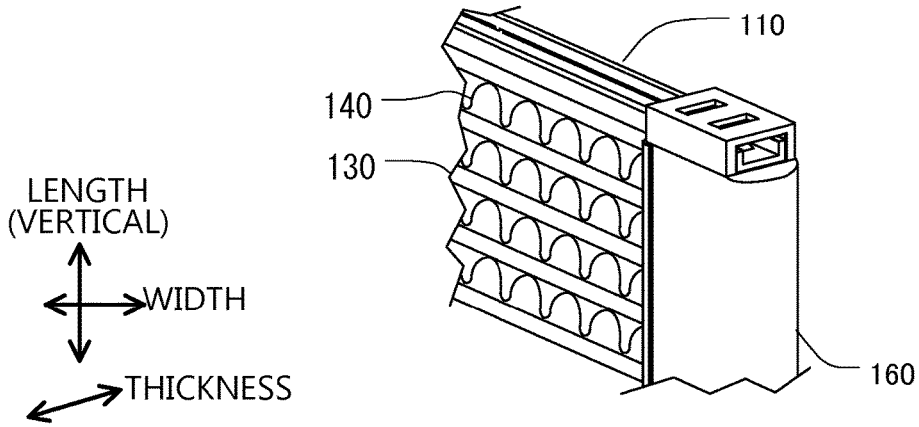
FIG. 3 is a perspective view showing a section III in FIG. 1.

The tank 160 has a holder 60. The tank 160 is equipped with a core plate 170 having multiple holes 170*a*. The one ends of the tubes 130 are inserted into the holes 170*a* of the core plate 170, respectively. Simultaneously, the plate 110 is inserted into the holder 60. Thus, as shown in FIG. 3, the fins 140, the tubes 130, the plates 110 and 120, and the tank are assembled into the radiator 100 as one component. The assembled radiator 100 may be brazed together. The tank 160 and the core plate 170 may be formed of resin or metal. The core plate 170 may be crimped onto the tank 160.

Figure 4:
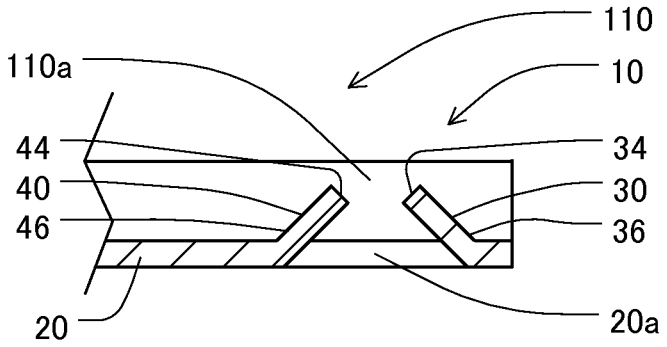
FIG. 4 is a sectional view showing the plate.
Figure 5:
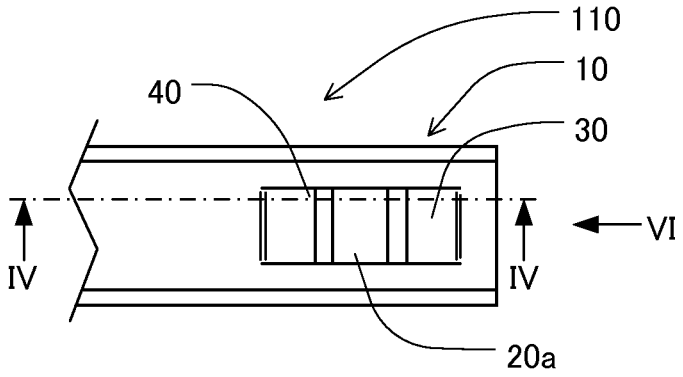
FIG. 5 is a top view showing the plate.
Figure 6:
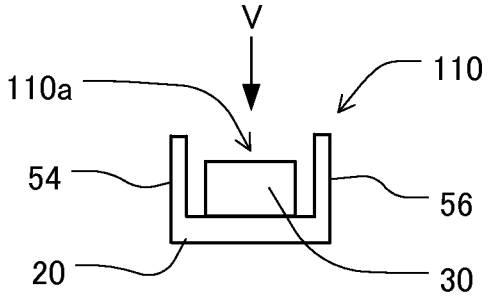
FIG. 6 is a front view showing the plate.

Subsequently, the plate 110 will be described with reference to FIGS. 4 to 6. FIG. 4 is a cross section taken along the line IV-IV in FIG. 5. FIG. 5 is a top view when viewed along the arrow V in FIG. 6. FIG. 6 is a front view when viewed along the arrow VI in FIG. 5.

The plate 110 may be formed by bending a metallic flat plate. The plate 110 includes a plate body 20 and two plate arms 54 and 56. The plate arms 54 and 56 extend from both sides of the plate body 20, respectively. The plate body 20 and the plate arms 54 and 56 form a plate space 110*a* in a rectangular shape. The plate 110 has a cross section in a U-shape in the front view in FIG. 6.

The plate body 20 includes two nails 30 and 40. Each of the nails 30 and 40 is in a rectangular shape in the top view in FIG. 5. Each nail 30 and 40 is cantilevered from the plate body 20 into the plate space 110*a*. Each nail 30 and 40 is inclined relative to the plate body 20. The nail 30 has a nail root 36 on the side of the plate body 20 and has a nail end 34 on the opposite side of the nail root 36. The nail 40 has a nail root 46 on the side of the plate body 20 and has a nail end 44 on the opposite side of the nail root 36.

The plate body 20 has a slot 20*a*, which is a through hole in a rectangular shape in the top view in FIG. 5. The slot 20*a* extends through the plate body 20. The nail roots 36 and 46 are adjacent to the slot 20*a*.

The nails 30 and 40 may be formed by stamping the plate body 20. Specifically, a blade of a die is pressed onto the plate body 20 from the rear side of the plate body 20 upward in FIG. 4 to cut the plate body 20 and to form three sides of each of the nails 30 and 40. The die is further thrusted into the plate body 20 to bend the nail roots 36 and 46 relative to the plate body 20. In this way, the nails 30 and 40 are bent and inclined relative to the plate body 20. The plate body 20 is partially formed into the nails 30 and 40, and the portion of the plate body 20, which corresponds to the nails 30 and 40, are cut to form the slot 20*a*. The nails 30 and 40 formed in this way are monolithic with the plate body 20.

In the present example, the nails 30 and 40 are identical to each other in the shape. In FIG. 4, the nails 30 and 40 are opposed to each other and at the same angle relative to the plate body 20. The nails 30 and 40 are, for example, at 45 degrees relative to the plate body 20. Each of the nail ends 34 and 44 may be machined and may have a flat surface. The nail ends 34 and 44 are, for example, at 45 degrees relative to the plate body 20.

Figure 7:
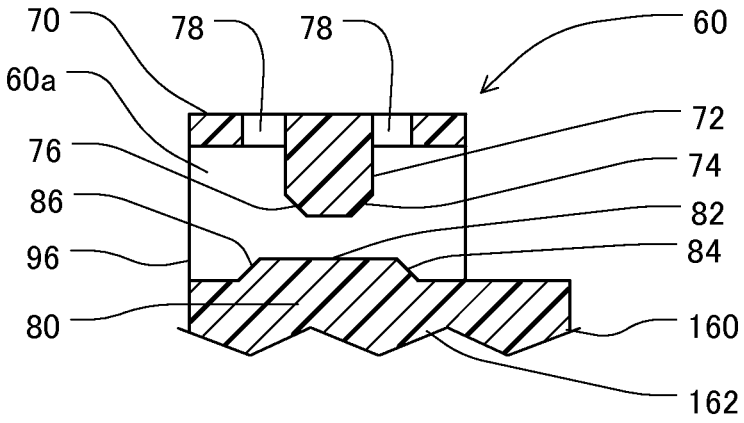
FIG. 7 is a sectional view showing a holder and the tank.
Figure 8:
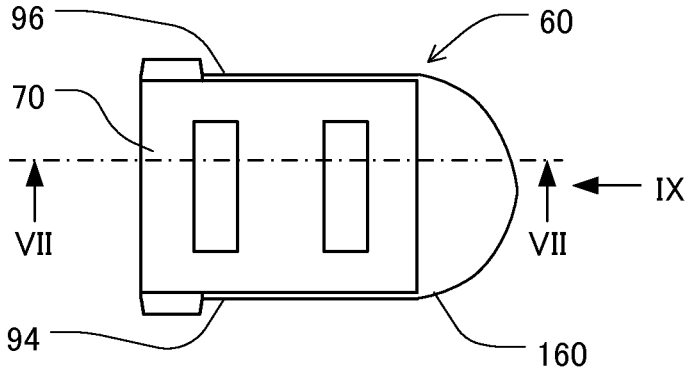
FIG. 8 is a top view showing the holder and the tank.
Figure 9:
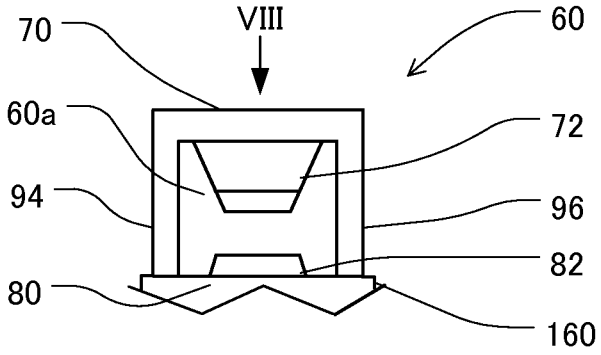
FIG. 9 is a front view showing the holder and the tank.

Subsequently, the holder 60 will be described with reference to FIGS. 7 to 9. FIG. 7 is a cross section taken along the line VII-VII in FIG. 8. FIG. 8 is a top view when viewed along the arrow VIII in FIG. 9. FIG. 9 is a front view when viewed along the arrow IX in FIG. 8.

As shown in FIGS. 4 to 6, the holder 60 has a hole 60*a* in which a plate end 10 of the plate 110 is to be inserted. The holder 60 is in a tubular shape to form the hole 60*a*.

The holder 60 is equipped to an end 162 of the tank 160. The tank 160 and the holder 60 may be integrally molded of resin by using slidable molding dies. The holder 60 has a main wall 70, side walls 94 and 96, and a bottom wall 80.

Each of the main wall 70, the side walls 94 and 96, and the bottom wall 80 may be in a flat plate shape. The side walls 94 and 96 extend from the main wall 70 toward the bottom wall 80 to form the hole 60*a*. Thus, the side walls 94 and 96, the main wall 70, and the bottom wall 80 form a hollow tube in a box shape. The hole 60*a* is in a rectangular shape, which corresponds to the cross section of the plate end 10 of the plate 110. In the present example, the bottom wall 80 is integrally molded with the end 162 of the tank 160.

The main wall 70 has a tab 72 extending into the hole 60*a*. The tab 72 is opposed to the bottom wall 80. The tab 72 has a cross section in a trapezoidal shape. The tab 72 has angled surfaces 74 and 76 on both sides.

The main wall 70 has two slits 78 each being in a rectangular shape. The two slits 78 extend through the main wall 70. The two slits 78 are adjacent to the tab 72.

The bottom wall 80 has a bump 82 extending from the bottom wall 80 into the hole 60*a*. The bump 82 is extended toward the tab 72 and is opposed to the tab 72. The bump 82 has a cross section in a trapezoidal shape. The bump 82 has angled surfaces 84 and 86 on both sides.

Subsequently, the holder 60 will be described with reference to FIGS. 4 to 6. FIG. 4 is a cross section taken along the line IV-IV in FIG. 5. FIG. 5 is a top view when viewed along the arrow V in FIG. 6. FIG. 6 is a front view when viewed along the arrow VI in FIG. 5.

Figure 10:
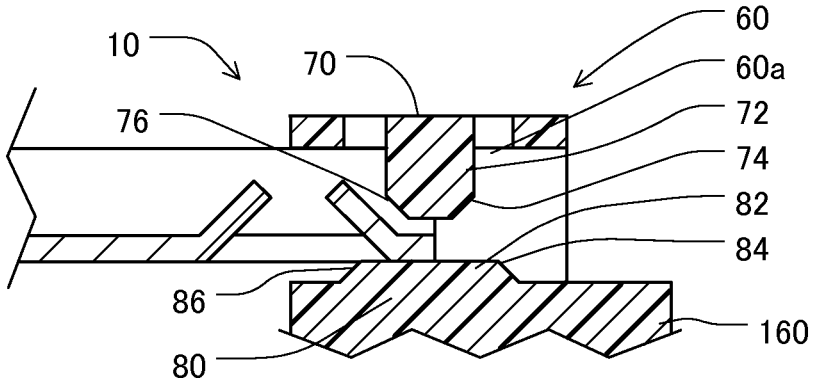
FIGS. 10 to 12 are sectional views showing a process to insert the plate into the holder.
Figure 11:
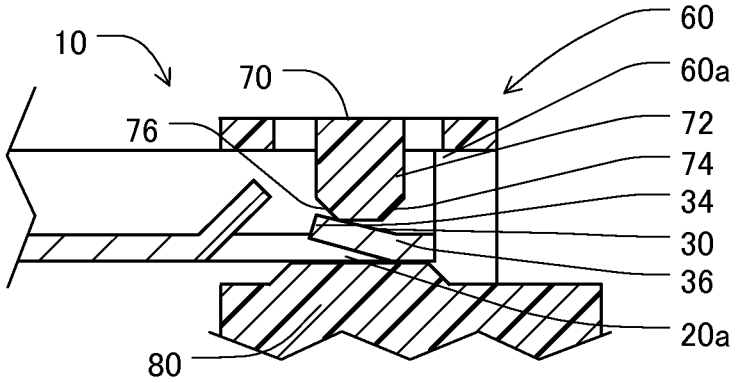
Figure 12:
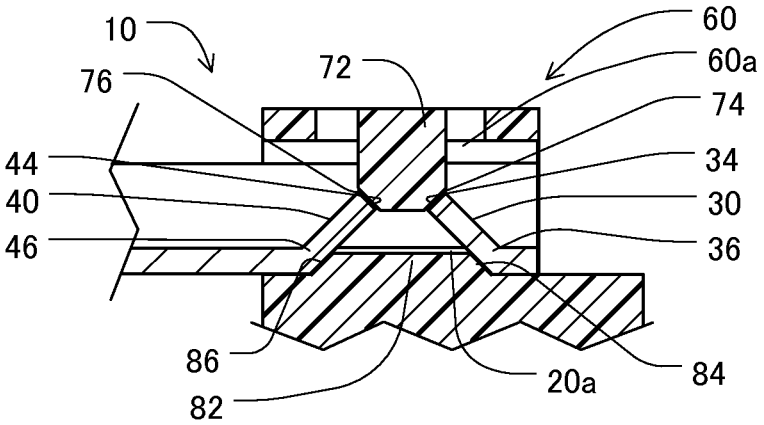

As shown in FIGS. 10 to 12, the plate end 10 is inserted into the holder 60 in this order. Specifically, in FIG. 10, the plate end 10 is inserted into the hole 60*a* of the holder 60 in an insertion direction. The plate end 10 is slid along the surface of the bump 82 and is moved on the bump 82.

In FIG. 11, the plate end 10 is further inserted into the hole 60*a* of the holder 60. As the plate end 10 is thrusted into the hole 60*a*, the nail 30 makes contact with the tab 72, and subsequently, the nail 30 is resiliently bent at the nail root 36 toward the slot 20*a*. Thus, the nail 30 is resiliently retracted into the slot 20*a*.

In FIG. 12, the plate end 10 is further inserted into the holder 60, and the plate end 10 is finally positioned in the holder 60 and is fixed to the holder 60. After the nail 30 is moved beyond the tab 72 in the insertion direction, the nail 30 is no longer depressed by the tab 72. Thus, the nail 30 resiliently recovers its original form before being inserted into the holder 60. In addition, the plate end 10 moves down in the hole 60*a* of the holder 60, as the slot 20*a* is fitted to the bump 82. In the state of FIG. 12, the nail ends 34 and 44 of both the nails 30 and 40 are opposed to the angled surfaces 74 and 76 of the tab 72. In addition, the bump 82 is accommodated in the slot 20*a* of the plate end 10. Specifically, the angled surfaces 84 and 86 of the bump 82 are along the surfaces of the nail roots 36 and 46, respectively. The nail ends 34 and 44 are latched to the angled surfaces 74 and 76 of the tab 72, respectively. The nail roots 36 and 46 are also latched to the angled surfaces 84 and 86 of the bump 82, respectively. Thus, the tab 72 and the bump 82 restrict movement of the nail 30 in the insertion direction.

In the state of FIG. 12, at least one of the nail ends 34 and 44 may be in contact with the angled surfaces of the tab 72. Alternatively, at least one of the nail ends 34 and 44 may be spaced from the angled surfaces of the tab 72. At least one of the nail roots 36 and 46 may be in contact with the angled surfaces 84 and 86 of the bump 82. Alternatively, at least one of the nail roots 36 and 46 may be spaced from the angled surfaces 84 and 86 of the bump 82.

In FIG. 12, the height of the plate 110 may be lower than the height of the hole 60*a* of the holder 60 by the height of the bump 82, in order to enable insertion of the plate 110 in the hole 60*a* beyond the bump 82. Alternatively, for example, the bump 82 may be formed of a soft material compared with the material of the tank 160, and the bump 82 may be adhered on the bottom surface of the holder 60. In this configuration, the bump 82 may be deformed and dented while the plate 110 is thrusted through the hole 60*a*, thereby to enable insertion of the plate 110 in the holder 60. The bump 82 may recover its shape after insertion of the plate 110 and may protrude in the slot 20*a* to support the plate 110.

As described above, the plate 110 is snap-fitted to the holder 60 and thereby integrated into one piece. Thus, the plate 110 may be supported by the holder 60 and may be restricted from falling off the core 100*a* and the tank 160.

Second Embodiment

Figure 13:
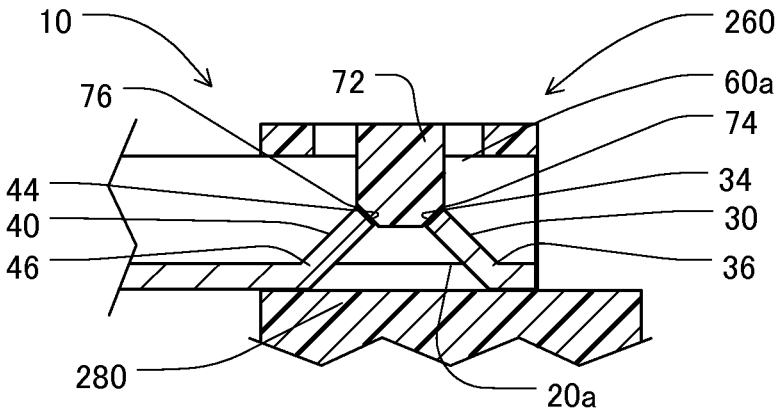
FIG. 13 is a sectional view showing the plate inserted in a holder according to a second embodiment.

As shown in FIG. 13, the bump 82 in the first embodiment may be omitted. A holder 260 of the present second embodiment has a bottom wall 280 defining a flat surface on which the plate end 10 is located. In the present embodiment, the height of the plate 110 may be same as or slightly lower than the height of the hole 60*a* of the holder 60. Even in the structure, the nail ends 34 and 44 are latched to the angled surfaces 74 and 76 of the tab 72, respectively. Thus, the tab 72 restricts movement of the nail 30 in the insertion direction.

Third Embodiment

Figure 14:
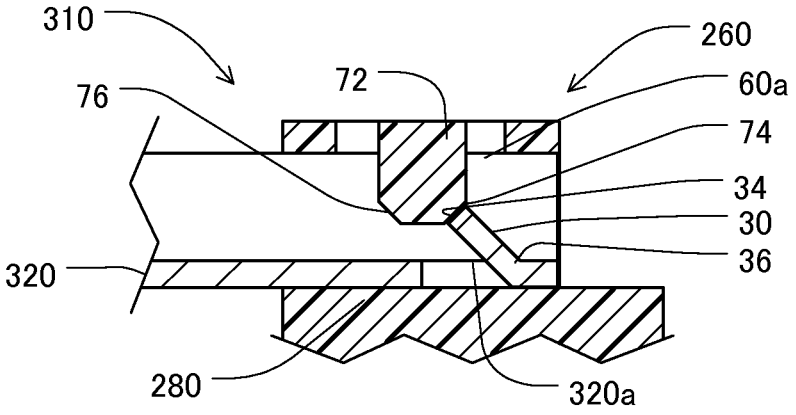
FIG. 14 is a sectional view showing a plate inserted in the holder according to a third embodiment.

As shown in FIG. 14, the nail 40 may be omitted. A plate end 310 of the present second embodiment only has the nail 30. The plate end 310 includes a plate body 320 having a slot 320*a*. The slot 320*a* is smaller than the slot 20*a* of the first embodiment.

On assumption that the tank 180 (FIG. 1) on the other side of the holder 60 and the tank 160 have a holder, which has a latch structure equivalent to that of the holder 60, the holder 260 may hold the nail 30 of the plate end 310 on one side. Thus, even in the structure of the third embodiment, the nail end 34 is latched to the angled surface 74 of the tab 72. Thus, the tab 72 restricts movement of the nail 30 in the insertion direction.

The configuration of the third embodiment may include a bump, which is similar to the bump 82 in the first embodiment.

Other Embodiment

As described above, the holders may be equipped to both ends of the tank, respectively. Alternatively, the holders may be equipped to one end of the tank. In this case, the plate may be inserted in the holder on one side of the core. In addition, the other plate may not be inserted in a holder. One tank may have the holder, and the other tank may not have the holder.

The holder may be a separate component from the tank and may be connected to the tank by, for example, adhesion or welding.

The nails may be separate components and may be welded to the plate body. The plate body may not have the slot.

For purposes of clarity, the same reference numbers will be used in the drawings to identify similar elements. As used herein, the phrase at least one of A, B, and C should be construed to mean a logical (A or B or C), using a non-exclusive logical or.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A heat exchanger comprising:

a core having a first side and a second side;

a plate attached along the first side of the core, the plate including a plate end protruding from the core;

a tank attached along the second side of the core; and a holder attached to the tank, the holder defining a insertion space therein into which the plate end is inserted in an insertion direction, wherein the holder includes a main wall, which is spaced away from the tank to define the insertion space, and a tab, which protrudes from the main wall toward the tank, the plate end includes a plate body, which faces the main wall when the plate end is inserted into the insertion space, and a plurality of nails, which each protrude from the plate body toward the main wall, wherein the plurality of nails are mirror imaged along a centerline of the tab, one of the plurality of nails has an original form and is configured to be resiliently bendable from the original form, one of the plurality of nails is resiliently bent by the tab while the plate end is being inserted into the insertion space, and the plurality of nails engages with the tab by resiliently returning to the original form when the plate end is inserted into the insertion space, the plurality of nails each have a nail end, the tab has a plurality of angled surfaces which are in contact with the nail ends of the plurality of nails the plurality of nails are angled relative to the plate body to incline away from the core when the plurality of nails are in the original shape;

wherein the holder includes a bump that is spaced away from the tab and protrudes toward the tab, the plate body defines a slot, and the bump is fit into the slot when the plate end is inserted into the insertion space;

wherein the bump has a plurality of angled surfaces, which is in contact along corresponding surfaces of the each of the plurality of nails, wherein one of the plurality of nails is angled relative to the plate body to incline away from the core when the one of the plurality of nails is in the original shape.

2. The heat exchanger according to claim 1, wherein the holder is attached to an end of the tank.

3. The heat exchanger according to claim 1, wherein the tank and the holder are integrally molded of resin.

4. The heat exchanger according to claim 1, wherein the core includes a plurality of tubes and a plurality of fins, the tubes and the fins are stacked alternately in parallel, and the plate is adjacent to one of the tubes or one of the fins.

5. The heat exchanger according to claim 1, wherein the plurality of nails protrude from the plate body by a protruding distance along a direction perpendicular to the plate body when the plurality of nails is in the original form, and the protruding distance is greater than a minimum distance between the tab and the plate body.

* * * * *